United States Patent [19]

Peck

[11] 4,226,186

[45] Oct. 7, 1980

[54] SEALED-VOLUME CARTRIDGE

[75] Inventor: William P. Peck, La Plata, Md.

[73] Assignee: The United States of America as represented by the Secretary of the Navy, Washington, D.C.

[21] Appl. No.: 950,944

[22] Filed: Oct. 13, 1978

[51] Int. Cl.[3] ..... F42B 5/10

[52] U.S. Cl. ..... 102/38 PP; 89/1 B; 102/43 R

[58] Field of Search ..... 102/38 R, 39, 38 PP, 102/42 R, 40, 43 R; 149/19.1, 22; 89/1 B

[56] References Cited

U.S. PATENT DOCUMENTS

| | | | |
|---|---|---|---|
| 3,672,301 | 6/1972 | Abbott | 102/39 |
| 3,724,870 | 4/1973 | Kurokawa et al. | 102/39 |
| 3,725,153 | 4/1973 | Schrader et al. | 149/19 |
| 3,755,020 | 8/1973 | Durfee | 149/22 |
| 3,830,057 | 8/1974 | Iwancrow et al. | 149/20 X |
| 3,858,392 | 1/1975 | Evans et al. | 149/24 X |
| 3,898,048 | 8/1975 | Barber et al. | 102/39 X |
| 3,963,541 | 6/1976 | Biermann et al. | 149/19.92 |
| 3,967,552 | 7/1976 | Settles et al. | 102/38 PP |
| 3,986,909 | 10/1976 | Marcri | 149/22 |
| 4,047,465 | 9/1977 | Wohlford | 102/38 |

*Primary Examiner*—Harold J. Tudor
*Attorney, Agent, or Firm*—R. S. Sciascia; A. L. Branning; T. E. McDonnell

[57] ABSTRACT

A gas-generating propellant for use in combination with sealed volume telescoping cartridges yields high pressure for cartridge operation and low residual pressure after cool down. The propellant formulation comprises a high percentage of condensible materials including a binder and an oxidizer and an optional fuel such as light metals and light metal compounds represented by boron, lithium, and lithium aluminum hydride.

3 Claims, 1 Drawing Figure

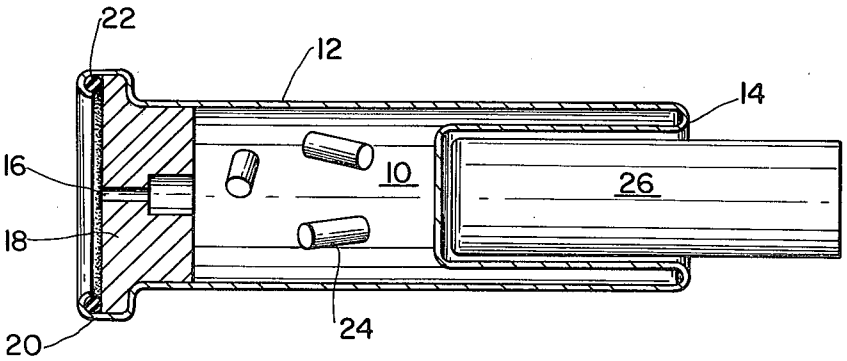
22
12
14
10
26
16
18
20
24

SEALED-VOLUME CARTRIDGE

BACKGROUND OF THE INVENTION

This invention relates to sealed volume cartridges and more specifically to sealed volume cartridges having a propellant formulation comprising materials whose combustion products are highly condensible.

A sealed volume cartridge such as a stores-separation impulse cartridge is typically an electrically ignited solid propellant cartridge designed to produce high ballistic gas power for a short duration. The theoretical energy of propellants used in such cartridges is in the neighborhood of 400,000 footpounds per pound of propellant and this energy is packaged in a compact cartridge envelope. For this reason, the cartridge is widely used as a power source for stores-separation equipment.

The first use of sealed volume cartridges began in the 1940's when it became apparent that a forceful ejection from high-speed aircraft was necessary. Air turbulence exists near the body and wings of aircraft, and stores must be forcibly ejected through the turbulence for clean and safe separation from the aircraft. The consequences of an ineffective ejection are stores tumbling, random motion, and possible impact with the aircraft.

Since the 1940's the number of stores separation applications has increased and new requirements have evolved. Additional cartridges have been added to fleet use to meet the new requirements. The ballistic power performance was changed to obtain higher efficiency by substituting a progressive burning grain design in place of the solid grains previously used. In addition, improved resistance to various environmental conditions such as altitude, and temperature was obtained by cartridge case design modifications.

SUMMARY OF THE INVENTION

Accordingly, there is provided by the present invention a sealed volume cartridge comprising a casing, an ignition means integrally connected to the casing and an ignitable propellant formulation having highly condensible combustion products. Said propellant formulation comprises from about 50 to about 95 weight percent of an inorganic oxidizer and from about 5 to about 50 weight percent of a resin binder. Additionally, an optional fuel selected from the group consisting of light metals and light metal components can comprise from about 10 to about 40 weight percent of the propellant formulations.

OBJECTS OF THE INVENTION

Therefore it is an object of the present invention to provide a sealed volume cartridge with a propellant formulation having highly condensible combustion products.

Another object of the present invention is to provide a safe sealed-volume cartridge.

Yet another object of the present invention is to provide a propellant having condensible combustion products.

Other objects, advantages, and novel features of the present invention will become apparent from the following detailed description of the invention when considered in conjunction with the accompanying drawing.

BRIEF DESCRIPTION OF THE DRAWING

The FIGURE is a cross-sectional view of a sealed-volume cartridge taken along its longitudinal axis.

DESCRIPTION OF THE PREFERRED EMBODIMENTS

Referring now to the FIGURE there is shown one embodiment of the sealed-volume cartridge 10. The cartridge 10 comprises a case 12 having a forward end 14 folded back into the case interior. The ignition means 16 is sealed and mounted into an aft closure 18 and then the aft closure 18 is integrally connected to the aft end 20 of the case 12. To insure that gas leakage will be prevented, a gas seal 22, such as an "O"-ring, can be inserted between the aft closure 18 and the aft end 20 of the case 12. Upon initiation of the ignition means 16, the main powder charge 24, housed within case 12, is ignited and combusted. High-pressure combustion gases expand and force the forward end 14 of the case 12 outward along its telescoping length. The piston-like apparatus 26 is then driven forward to accomplish ejection. Since the combustion gases and their by-products are fully contained, the cartridge 10 represents a clean source of power, even if "dirty" propellants are used. Therefore, alternate propellant formulations can be considered for use in the telescoping-cartridge concept, even though they were previously unsuitable.

The propellant formulations used in combination with the sealed-volume cartridge are unique in that they yield a high pressure for operation of the cartridge, and also provide a substantially reduced residual pressure after cartridge functioning and cool down. This result is accomplished by preparing a propellant formulation having a high percentage of condensible materials in the combustion product. Upon cool down, these combustion products will condense into liquids and solids, thereby significantly reducing internal pressure.

The propellant formulations used in the present invention include from about 50 to about 95 weight percent of an alkali metal oxidizer such as potassium perchlorate, potassium nitrate, and sodium nitrate. The preferred oxidizer is potassium perchlorate. Additionally, from about 5 to about 50 weight percent of a resin binder such as rubber, polybutadiene, polysulfide, and polyethylene is admixed with the oxidizer. The preferred resin binder is rubber. The preferred percentages of these two propellant ingredients ranges from about 65 to about 85 weight percent of an alkali metal oxidizer and from about 15 to about 35 weight percent of a resin binder. The most preferred composition comprises about 80 weight percent of an alkali metal oxidizer and about 20 weight percent of a resin binder. As an option, additive materials which produce condensible combustion products, such as halogenated hydrocarbons, may be incorporated into the basic propellant.

In addition to the above propellant formulation, an additional high-energy material capable of forming gaseous products at high tempeatures and which reduce to liquids or solids at ambient temperatures can be incorporated. Representative materials are light metals and light metal compounds such as boron, lithium, magnesium, aluminum, lithium hydride, aluminum hydride, and lithium aluminum hydridge. The preferred metal and metal compounds are boron, lithium, and lithium aluminum hydride. The most preferred metal is boron. These ingredients can be incorporated into the propellant formulation in a range from about 10 to about 40 weight percent of the total propellant. The preferred range appears to vary from about 10 to about 20 weight percent of the total propellant.

Thus, it is apparent that there is provided by this invention a sealed-volume cartridge with a propellant having highly condensible combustion products.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. A high-pressure, sealed-volume stores-separation cartridge, which comprises:

a casing;

an ignition means, integrally connected to said casing; and an ignitable main powder charge housed within said casing, and wherein said charge comprises a condensible propellant formulation consisting essentially from about 65 to about 85 weight percent of potassium perchlorate, from about 10 to about 20 weight percent of a high-energy material selected from the group consisting of light metals and light-metal compounds, and a resin binder selected from the class consisting of polybutadiene, polysulfide, and polyethylene.

2. The sealed-volume cartridge of claim 1 wherein said light metals and light metal compounds are selected from the group consisting of boron, lithium and lithium aluminum hydride.

3. The sealed volume cartridge of claim 2 wherein said light metal is boron.

* * * * *